US008277400B2

(12) United States Patent
Starner

(10) Patent No.: US 8,277,400 B2
(45) **Date of Patent: *Oct. 2, 2012**

(54) SELF ADMINISTERED CHEST PHYSIOTHERAPY SYSTEM

(76) Inventor: Alan Lee Starner, Fort Collins, CO (US)

( * ) Notice: Subject to any disclaimer, the term of this patent is extended or adjusted under 35 U.S.C. 154(b) by 1176 days.

This patent is subject to a terminal disclaimer.

(21) Appl. No.: 12/072,322

(22) Filed: Feb. 25, 2008

(65) Prior Publication Data

US 2009/0216162 A1 Aug. 27, 2009

(51) Int. Cl.
*A61H 1/00* (2006.01)

(52) U.S. Cl. ..... 601/49; 601/44; 601/46; 601/98

(58) Field of Classification Search ..... 601/41–44, 601/46–48, 49, 67–71, 78–79, 148–153; 5/632, 633, 915

See application file for complete search history.

(56) References Cited

U.S. PATENT DOCUMENTS

| | | | | | |
|---|---|---|---|---|---|
| 3,060,925 | A * | 10/1962 | Honsaker et al. | ..... | 601/24 |
| 3,752,154 | A * | 8/1973 | Clark | ..... | 601/51 |
| 4,170,986 | A * | 10/1979 | Hinshaw et al. | ..... | 5/633 |
| 4,550,901 | A * | 11/1985 | Muchisky et al. | ..... | 5/630 |
| 4,635,306 | A * | 1/1987 | Willey | ..... | 5/632 |
| 4,838,263 | A | 6/1989 | Warwick et al. | | |
| 5,086,755 | A * | 2/1992 | Schmid-Eilber | ..... | 601/47 |
| 5,437,608 | A * | 8/1995 | Cutler | ..... | 601/49 |
| 6,290,661 | B1 * | 9/2001 | Cutler et al. | ..... | 601/49 |
| 6,375,630 | B1 * | 4/2002 | Cutler et al. | ..... | 601/57 |
| 7,018,348 | B2 * | 3/2006 | Van Brunt et al. | ..... | 601/152 |
| 7,553,288 | B2 * | 6/2009 | Cohen | ..... | 601/47 |
| 7,918,308 | B2 * | 4/2011 | Cohen | ..... | 181/150 |

* cited by examiner

*Primary Examiner* — Annette Dixon

(74) *Attorney, Agent, or Firm* — Craig R. Miles; CR Miles, P.C.

(57) ABSTRACT

A chest physiotherapy device which allows self administered chest physiotherapy to assist in transfer of airway passage secretions.

14 Claims, 5 Drawing Sheets

SELF ADMINISTERED CHEST PHYSIOTHERAPY SYSTEM

I. BACKGROUND

A chest physiotherapy device which allows self administered chest physiotherapy to assist in transfer of airway passage secretions.

Normally, the exocrine glands secrete substances onto the surfaces of airway passages as a protection for the lining of the airway passages. In the lungs, these secreted substances also assist in the transport of particles out of the airways. For persons with certain diseases such as cystic fibrosis ("CF"), these secretions may become excessive or altered as to composition or as to chemical properties of certain constituents.

As a non-limiting example, persons with CF may have excessive production of thick, sticky mucus in the airways. Several factors may contribute to the abnormality of the mucus. The cells lining the airways of persons with CF may not transport salt and water normally, so mucus and other airway passage secretions may be depleted of water, thus becoming abnormally viscous. There may also be structural changes in the proteins of the mucus. As a result, the mucus of persons with CF can become so viscous that it obstructs the airway passages. White blood cells recruited into the lungs to fight infection may also die and release their genetic material to the mucus which exacerbates the problem by making the mucus even thicker. CF and other conditions such as Chronic Obstructive Pulmonary Disease can also produce abnormal secretions which can impair clearance of airway passages.

To dislodge secretions which obstruct airway passages, persons cough frequently. Persons which produce a greater than normal amount of airway passage secretions or abnormally viscous or sticky airway passage secretions may require daily chest and back percussion and body positioning to assist in transfer of these airway passage secretions from airway passages.

A substantial problem for persons which require daily chest or back percussion can be that the treatment cannot be self administered. Chest and back clapping requires the participation of a therapist to administer repeated chest and back claps. This repeated therapy with the assistance of a therapist can be expensive, inconvenient and time consuming.

Certain attempts have been made to address this problem by the provision of devices which deliver oscillations to the chest. For example, as described by U.S. Pat. No. 4,838,263 a garment or vest ("vest type device") can be worn by a person which generates oscillations by change in pneumatic pressure within the vest. However, there are problems with vest type devices in that the wearer may be prevented from being positioned in an inclined or semi-inverted position ("inclined position"), the frequency and amplitude of the oscillations produced by vest type devices can be insufficient to dislodge airway passage secretions, the vest type product must be sized to the wearer and can be uncomfortable to use due to pressure delivered to the chest from the vest type device. The lack of comfort can significantly reduce patient compliance. Additionally, the vest can be difficult for young children to use without caregiver assistance, and is generally not appropriate for children under the age of two.

The instant inventive chest physiotherapy device addresses each of the substantial problems above-described.

II. SUMMARY OF THE INVENTION

Accordingly, a broad object of the invention can be to provide chest physiotherapy device which allows self administered chest physiotherapy to assist in transfer of airway passage secretions.

A second broad object of the invention can be to provide a chest physiotherapy device which induces sufficient vibration in the chest to assist in the transfer of airway passage secretions which engages a person without the use of a vest type device.

A third broad object of the invention can be to provide a chest physiotherapy device which allows a person to assume an inclined position as vibrations are induced in the chest to allow the force of gravity to assist in transfer of airway passage secretions.

A fourth broad object of the invention can be to provide a chest physiotherapy device which induces vibrations in the chest of greater frequency, greater amplitude, or both greater frequency and greater amplitude than can be manually delivered by a therapist or through a vest type device.

A fifth board objective of the invention can be to provide a chest physiotherapy device which can be utilized by a broader range of patients, including without limitation patients with medical conditions for which conventional manual chest or back percussion therapy is to a greater of lesser degree ineffective, patients which to a greater or lesser degree cannot tolerate conventional manual chest or back percussion therapy, patients which are voluntarily or involuntarily restricted from using conventional manual chest or back percussion therapy, young patients, and the like.

A sixth board objective of the invention can be to provide a chest physiotherapy device which promotes a greater degree of compliance.

A seventh broad object of the invention can be to provide a method of self-administered chest physiotherapy effective in the transfer of airway passage secretions.

Naturally, further objects of the invention are disclosed throughout other areas of the specification, drawings, photographs, and claims.

III. A BRIEF DESCRIPTION OF THE DRAWINGS

IV. DETAILED DESCRIPTION OF THE PREFERRED EMBODIMENTS

Figure 1:
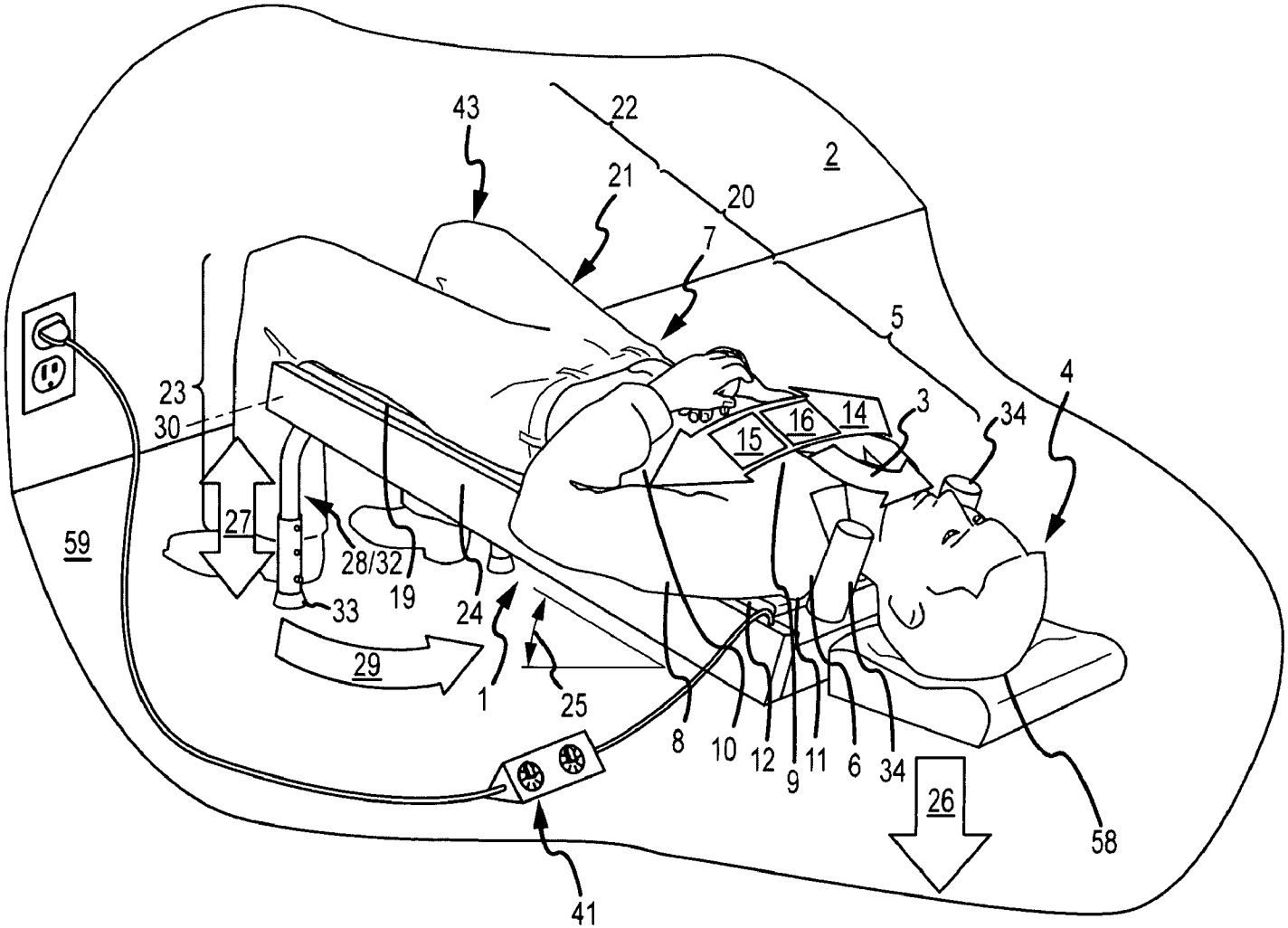
FIG. 1 shows a particular method of self-administered chest physiotherapy.

A chest physiotherapy device (1) and method of self administered chest physiotherapy (2) which assists in the transfer of airway passage secretions (3).

For the purposes of the present invention, the term "a" or "an" entity refers to one or more of that entity; for example, "a vibration generator" refers to one or more vibration generator (s) or at least one vibration generator. As such, the terms "a" or "an", "one or more" and "at least one" can be used interchangeably herein. Furthermore, the term "selected from the group consisting of" refers to one or more of the related elements in the list that follows, including combinations of two or more of the listed elements.

Ranges may be expressed herein as from "about" one particular value to "about" another particular value. When such a range is expressed, one embodiment of the invention includes from approximately the one particular value to approximately the other particular value and another embodiment includes from the one particular value to the other particular value. It will be further understood that the endpoints of each of the ranges are significant both in relation to the other endpoint, and independent of the other endpoint. Similarly, when a value is expressed as an approximation by use of the antecedent "about," it will be understood that an embodiment of the invention includes approximately the particular value while the particular value forms another embodiment of the invention.

The term "a person (4)" for the purposes of this invention broadly encompasses any individual regardless of age or sex which can use the inventive chest physiotherapy device (1) or the method of chest physiotherapy (2) described herein.

The term "airway passage secretions (3)" for the purposes of this invention broadly encompasses any substance or combination of substances retained by, located in, or secreted onto airway passages of a person and as non-limiting examples airway passage secretions can include those airway passage secretions of the exocrine glands, mucus, mucus-like substances, or water, or combinations and permutations thereof.

The term "airway passage" for the purpose of this invention means the passages of the lungs, bronchial tree, and trachea, or the like in which airway passage secretions (3) can be located.

The term "chest (5)" for the purpose of this invention means all portions or parts of a person (4) between about the top of the shoulders (6) and about the waist (7) excluding the arms (8) defined by the external surface (front side (9), sides (10) and backside (11)) of the person (4). The term "inside the chest" for the purposes of this invention means the volume defined by the external surface of the chest (5) of a person (4) having within the structures of the airway passage, including, without limitation, the trachea, bronchi and lungs.

For the purpose of this invention, the term "transfer of airway passage secretions (3)" (the transfer being depicted by the arrow which includes the reference numeral (3) in FIG. 1) means a level, or a therapeutically effective level, of dislodgement, displacement, elimination, or travel of airway passage secretions (3) within or from at least a part of the airway passages of a person (4).

Figure 2:
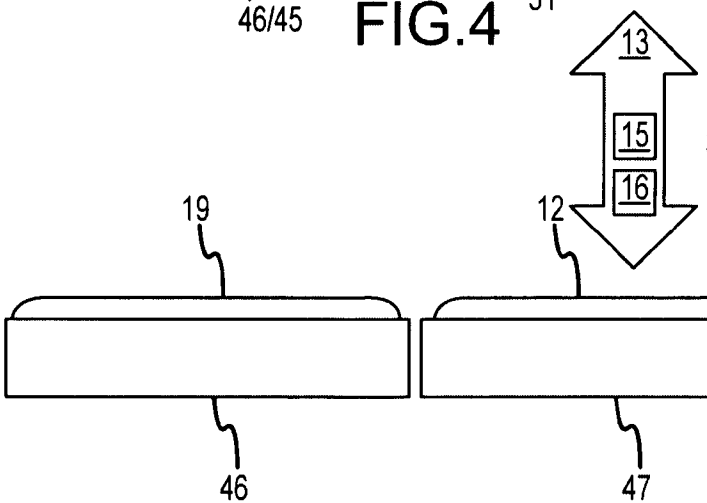
FIG. 2 is a side view of a particular embodiment of the inventive chest physiotherapy device.
Figure 3:
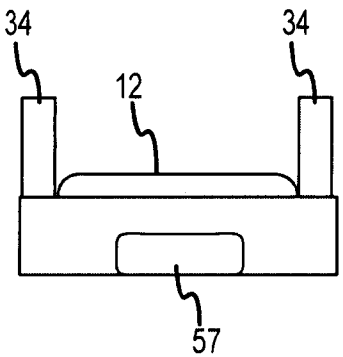
FIG. 3 is a front end view of a particular embodiment of the inventive chest physiotherapy device.
Figure 8:
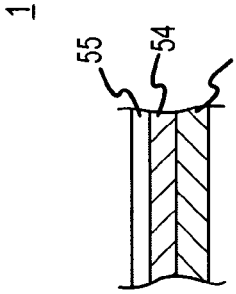
FIG. 8 is an enlarged cross section view of FIG. 7 which shows a part of the chest panel having a pad layer and a cover layer.
Figure 6:
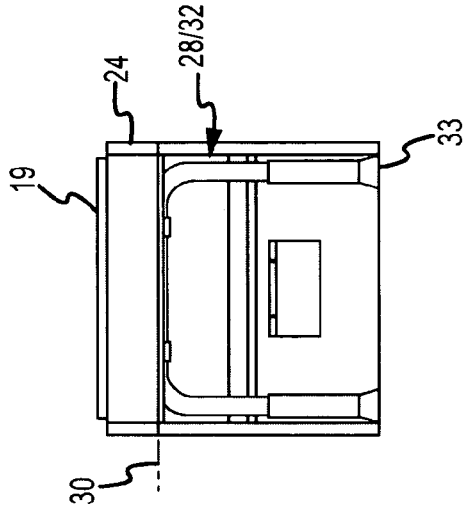
FIG. 6 is back end view of a particular embodiment of the inventive chest physiotherapy device in the inclined position.
Figure 7:
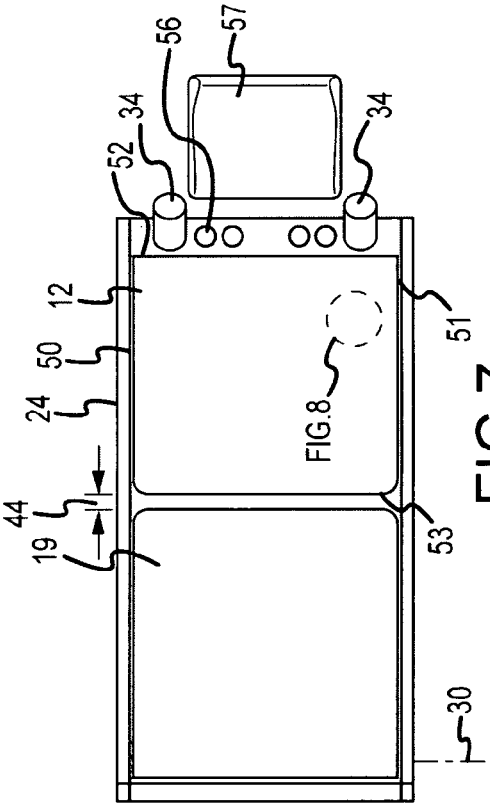
FIG. 7 is a top view of a particular embodiment of the inventive chest physiotherapy device.

Now referring primarily to FIG. 1, which shows a non-limiting example of a method of self administered chest physiotherapy (2), a person (4) can by engaging a chest plate (12) (see also FIGS. 2-5) to a part of the chest (5) and by generating an amount of vibration (13) (depicted by arrow in FIG. 2 which includes reference numeral (13)) in the chest plate (12) induce a sufficient amount of chest vibration (14) (vibration in the chest (5) depicted by the arrow in FIG. 1 which includes reference numeral (14)) which can assist in transfer of airway passage secretions (3) (depicted by the arrow in FIG. 1 including the reference numeral (3)); however, any arrows shown in the Figures are not to be understood to convey any limitation as to the direction or magnitude of any force.

Again referring primarily to FIG. 1, the method of self administered chest physiotherapy (2) can further include the steps of variably adjusting the amount of vibration (13) in the chest plate (12) and can further include the step(s) of adjusting the amplitude (15) (depicted as block (15)) of the amount of vibration (13) or adjusting the frequency (16) (depicted as block (16)) of the amount of vibration (13) in the chest plate (12) (see also FIGS. 2 and 5) which independent of each other or in various combinations, permutations, or ranges can provide a sufficient level of chest vibration (14) to assist in transfer of airway passage secretions (3).

Figure 10:
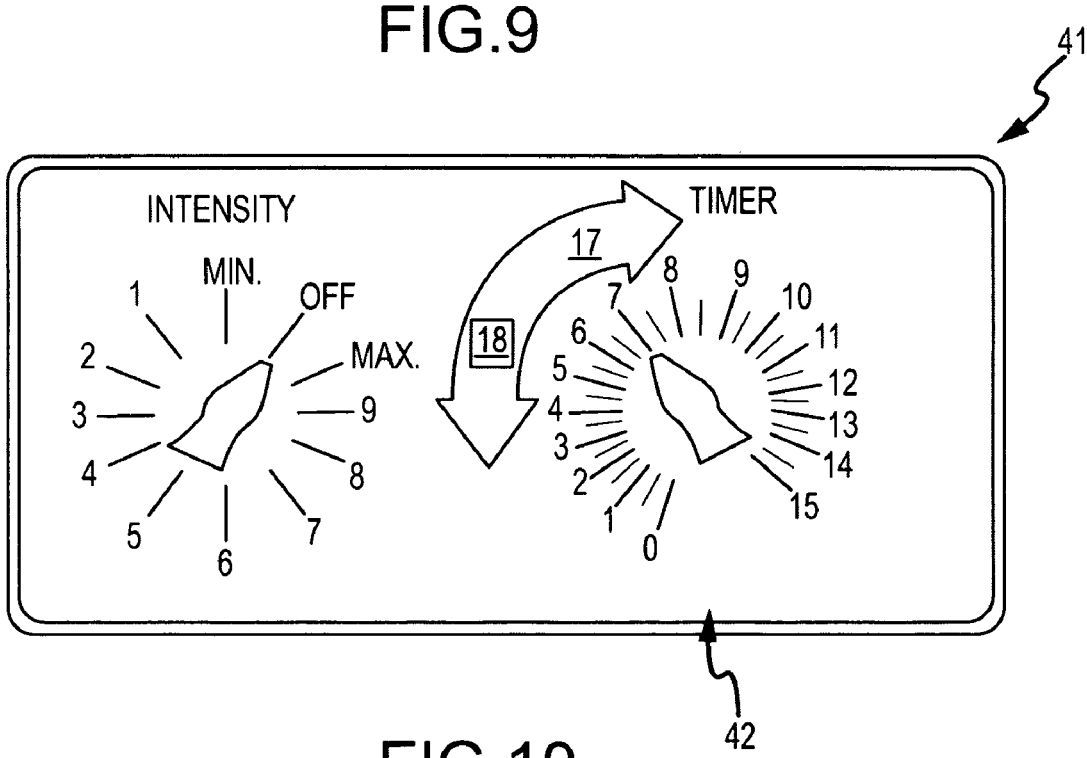
FIG. 10 is a front view of a particular embodiment of a vibration controller used with embodiments of the inventive chest physiotherapy device.

Referring primarily to FIGS. 1 and 10, the method of self administered chest physiotherapy (2) can further include the step of timing (17) (depicted by arrow in FIG. 10) duration of the amount of vibration (13) in the chest plate (12). As to certain embodiments of the invention, timing (17) duration of the amount of vibration (13) can include establishing a duration of vibration time (18) in which the chest plate (12) vibrates and upon elapse of the duration of vibration time (18) the chest plate (12) stops vibrating. As to other particular embodiments of the invention, the step of timing (17) duration of the amount of vibration (13) can include a determination or assessment of the amount of time the chest plate (12) has vibrated. Understandably, certain embodiments of the invention can provide both a timing function which upon elapse of a pre-selected duration of time stops the amount of vibration (13) in the chest plate (12) and a timing function which assesses elapsed time of vibration of the chest plate (12).

Again referring primarily to FIG. 1, the method of self administered chest physiotherapy (2) can further include the steps of engaging a hip panel (19) to a part of a hip (20) of a person (4). The "hip" (20) of a person (4) means all parts of a person (4) between about the waist (7) and about the level of the crotch (21) (front side (9), sides (10) and backside (11)) of the person (4). Certain embodiments of the hip panel (19) may be configured to further engage the upper legs (22) as shown in FIG. 1; and a description of a hip panel (19) which engages the hip (20) of a person (4) includes those embodiments of the invention which further support the upper legs (22) and includes some embodiments of the invention which may further support the lower legs (23).

Still referring primarily to FIG. 1, the method of self administered chest physiotherapy (2) can further include the step of discretely coupling the hip panel (19) and the chest plate (12) to a support frame (24). The term "discretely coupling" for the purposes of this invention means that the hip panel (19) and the chest plate (12) are coupled or are responsive to the support frame (24) in a manner which allows the steps of generating an amount of vibration (13) in the chest plate (12) engaged to a part of the chest (5) of a person (4) without generating a substantial amount of vibration in the hip panel (19). Certain embodiments of the invention, can further include the step of isolating vibration to the chest plate (12).

Again referring to FIG. 1, the method of self administered chest physiotherapy can further include the step of establishing an amount of incline (25) of the person (4) having a part of the chest (5) engaged to said chest plate (12) sufficient to allow force of gravity (26) to assist in transfer of the airway passage secretions (3). The amount of incline (25) can be established by adjusting the height (27) of a height elevation assembly (28). As to certain embodiments of the invention the step of adjusting the height (27) of the height elevation assembly (28) can be achieved by pivoting (29) the height elevation assembly (28) about a pivot axis (30) between a retracted condition (31) (see for example FIG. 9) which can establish the hip panel (19) and the chest plate (12) at substantially equal height and an extended condition (32) (see for example FIG. 1) which establishes the hip panel (19) at a greater height than the chest plate (12). As to other embodiments of the invention, the step of adjusting the height (27) of the height elevation assembly (28) can achieved by extension and retraction of a part of the height elevation assembly (28).

Again referring to FIG. 1, the method of self administered chest physiotherapy (2) can further include the step of engaging the top of each of a pair of shoulders (6) of a person (4) with a corresponding pair of shoulder engagement elements (34) to locate a part of the chest (5) to engage the chest plate (12). The person (4) can perform the method of self administered chest physiotherapy (2) at an amount of incline (25) by performing the steps above described to induce a sufficient amount of chest vibration (14) to assist in the transfer of airway passage secretions (3) in the chest (5).

Figure 11:
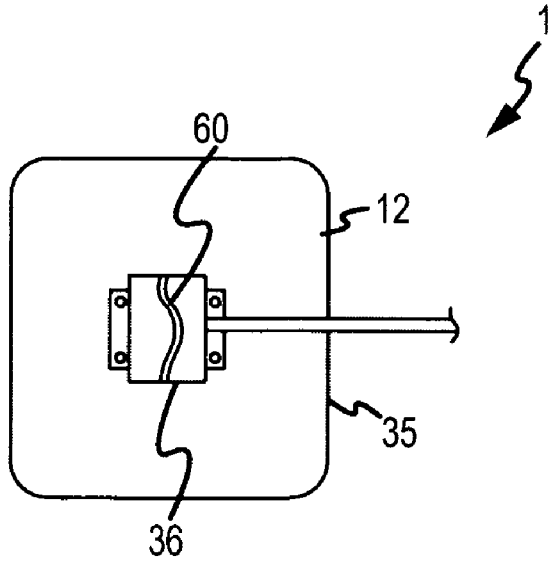
FIG. 11 is back view of another particular embodiment of the inventive chest physiotherapy device.
Figure 12:
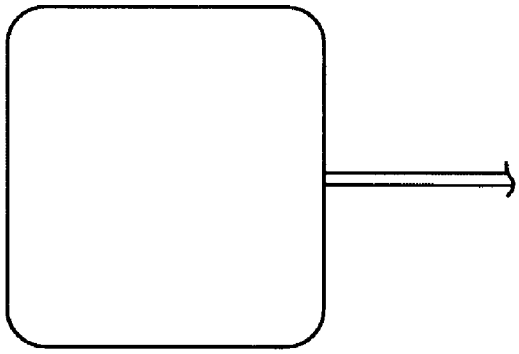
FIG. 12 is front view of the particular embodiment of the inventive chest physiotherapy device shown in FIG. 11.
Figure 13:
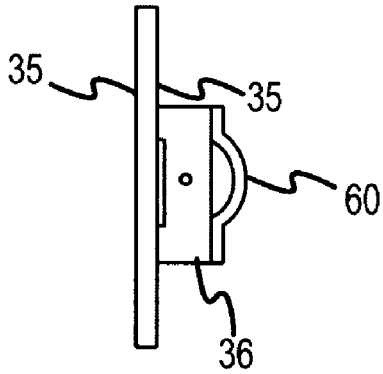
FIG. 13 is a side view of the particular embodiment of inventive chest physiotherapy device shown in FIGS. 11 and 12.

Now referring primarily to FIGS. 11-13, certain embodiments of the inventive chest physiotherapy device (1) which can be used to perform the method of self administered chest physiotherapy (2) can provide a discrete chest plate (12) configured to portably engage a part the chest (5) of a person (4). The chest plate (12) can be configured to provide a pair of generally planar surfaces (35) disposed in generally parallel opposed relation a distance apart (typically equal to the thickness of the material); however, the invention is not so limited, and embodiments of the chest plate (12) can provide an amount of curvature or other constructional form which allows an increased level of engagement with a part of the chest (5). The non-limiting embodiment of the inventive chest physiotherapy device (1) shown in FIGS. 11-13 has a configuration which allows releasable gripping engagement of a grip (60) (directly or indirectly coupled to the chest plate (12)) to make portable or generate travel in the chest physiotherapy device (1) between a first location and a second location, or to position the planar surface (35) at a location on the chest (5). Chest vibration (14) can then be induced in the chest (5) of the person (4) for a period of time (17). The planar surface (35) can then be disengaged from the chest (5) by gripping engagement of the grip (6) to position the planar surface (35) at another location on the chest (5) to induce chest vibration (14) for another period of time (17). The chest plate (12) can be grippingly engaged by the grip (60) to position the planar surface (35) a distance from the chest (5) at the end of the particular method of chest physiotherapy (2).

Typically, embodiments of the chest plate (12) can be produced from sheet material such as plastic, metal, wood, or the like in which an amount of vibration (13) can be generated. The chest plate (12) can provide a thickness of between about one-eighth of an inch to about one inch depending on the application. The particular embodiment of the invention shown in FIGS. 11-13 provides a chest plate (12) produced from a sheet of metal, plastic or wood having a thickness of about three-eighths of an inch. Each of the pair of planar surfaces (35) can bound an area having a width and height of about one half the width of the chest (5) of a person (4); however, other embodiments of the invention (such as the embodiment shown in FIG. 1) can provide a chest plate (12) produced from a sheet of metal, plastic, wood, or the like having a thickness of about one-eighth of an inch to about one inch each surface having an area bound by a width of about the width of the chest (5) and a length of about the distance between the waist (7) and the top of the shoulders (6). While the embodiments of the chest plate (12) shown by the Figures are generally square or rectangular in shape, the invention is not so limited and the area of the chest plate can bound other configurations depending on the application.

Figure 9:
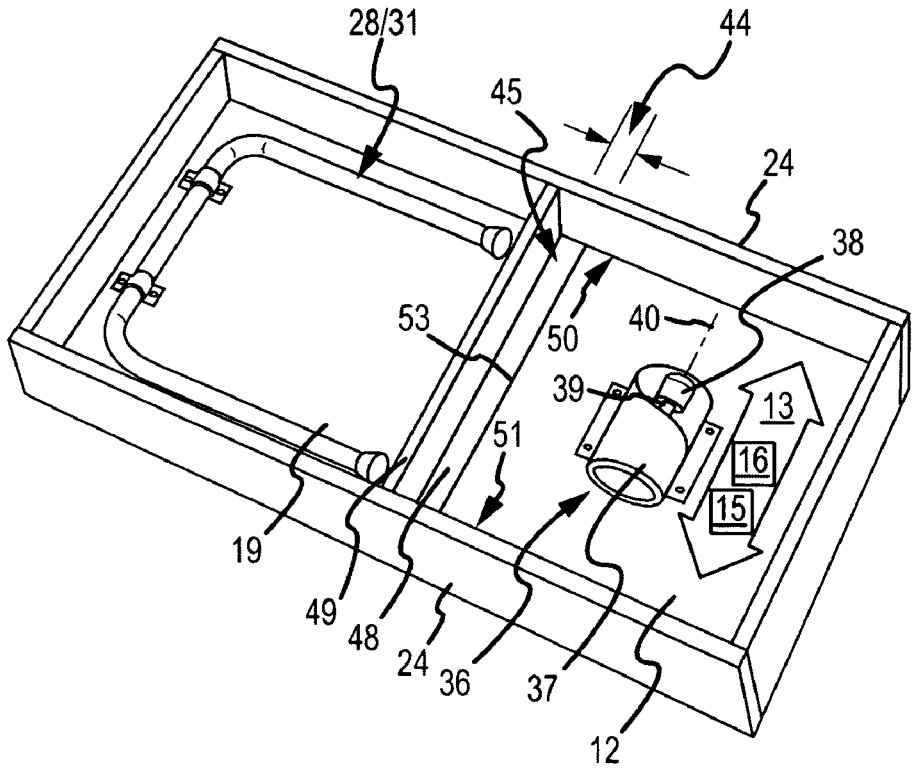
FIG. 9 is a bottom view of a particular embodiment of the inventive chest physiotherapy device.

Now referring primarily to FIGS. 9 and 11, embodiments of the inventive chest physiotherapy device (1) can further include a vibration generator (36) coupled to the underside of the chest plate (12). The vibration generator (36) operates to generate the amount of vibration (13) in the chest plate (12). As to certain embodiments of the invention, the vibration generator (36) can produce a periodic wave form having a particular frequency (16) and amplitude (15). The vibration generator (36) and the particular frequency (16) and amplitude (15) of the wave form associated with the particular vibration generator (36) can be selected based on the constructional form of the chest plate (12) and corresponding function of the chest plate (12) when engaged to a part of the chest (5) to induce a sufficient amount of chest vibration (14) to assist in transfer of airway passage secretions (3). A non-limiting type of vibration generator (36) that can be utilized to practice the invention to induce sufficient chest vibration (14) to assist in transfer airway passage secretions (3) can be a motor (37) (such as an electric motor powered by direct or alternating current) providing an offset weight (38) coupled to a motor shaft (39) (see for example FIG. 9). As the motor shaft (39) rotates about a motor shaft axis (40), the offset weight (38) rotates along a closed arc causing an amount of vibration (13) in the chest plate (12). Understandably, other constructional forms of a vibration generator (36) can be utilized to practice the invention, such as a piezoelectric vibrator of lithium tantalate, an electric solenoid, or the like.

As to other embodiments of the invention, the vibration generator (36) can further include a vibration controller (41) which can allow adjustment of the frequency (16) of the amount of vibration (13) in the chest plate (12) and the amplitude (15) of the amount of vibration (13) in the chest plate (12), or both, whether separately or in combination. Adjustment of the frequency (16) or the amplitude (15) of the amount of vibration (13) in the chest plate (12) can be made based on the level of chest vibration (14) achieved by engagement of the chest plate (12) with the chest (5) of the person (4). The type vibration controller (41) utilized to practice the invention can be correspondingly matched to the type of vibration generator (36). For example, the vibration controller (41) utilized with the motor (37) with an offset weight (38) above-described can operate to variably adjust the rotations per minute of the motor shaft (39) which results in greater or lesser frequency (16) and amplitude (15) of the amount of vibration (13) in the chest plate (12). Alternately, the rotations per minute can be held constant and a greater or lesser imbalance in the offset weight (38) can be achieved to adjust amplitude (15) of the amount of vibration (13) in the chest plate (12).

The vibration generator (36) can further provide a timer (42) which can function to control the duration of vibration time (18) of the vibration generator (36). As a non-limiting example, a suitable timer can be a 16-bit timer for use in motor control available for example from Renesas Technology Corporation, 450 Holger Way, San Jose, Calif. Alternately, the timer (42) can function to monitor the duration of time the vibration generator (36) operates.

Now referring primarily FIGS. 1-9, embodiments of the invention can further include hip panel (19) configured to engage a part of the hip (20). As shown in the Figures, certain embodiments of the hip panel (19) can have a width which corresponds to about the width of the hip (20) of a person (4) and a length which corresponds to the distance between about the waist (7) and the knees (43) of the person (4); however, the invention is not so limited and the hip panel (19) can have any configuration capable of supporting the hip (20) of a person (4) while the chest plate (12) engages the chest (5) of the person (4). As shown in the non-limiting examples of FIGS. 1-9 the hip panel (19) and the chest plate (12) bound substantially similar surface areas of similar geometry; however, these particular embodiment of the invention are not intended to be limiting with respect to the numerous and varied configurations in which the hip panel (19) can be practiced.

The embodiment of the hip panel (19) shown in FIGS. 1-9 can be produced from a sheet material of metal, plastic, wood or the like having a thickness of about one-eighth of an inch to about three quarters of an inch; however, other embodiments of the invention can provide a hip panel (19) produced from a sheet of metal, plastic, wood or the like, having a thickness of about one-eighth of an inch to about one inch, or of even greater or lesser thickness, depending on the application. Again, this example is not intended to be limiting with respect to the configuration or method by which the hip panel (19) can be practiced or produced and the hip panel (19) (and the chest plate (12)) can be produced from sheet material or can alternately be molded, extruded, or cast to provide a hip panel (19) having a particular configuration or constructional form depending on the application.

In FIGS. 1-9, the hip panel (19) and the chest plate (12) are disposed in planar relation to provide a generally flat surface which engages a part of the hip (20) and a part of the chest (5) of a person (4). However, the surface of the hip panel (19) and the surface of the chest plate (12) can each define a separate plane which can be disposed in a variety of spatial relations which allow the hip panel (19) to engage a part of a hip (20) of a person (4) and the chest plate (12) to engage a part of the chest (5) of a person (4).

As to certain embodiments of the invention, the hip panel (19) and the chest plate (12) can be produced from a single piece of material with a first portion engaging a part of the chest (5) of a person (4) and a second portion engaging a part of the hip (20) of a person (4). Generally, however, the chest plate (12) and the hip panel (19) are each produced as a discrete element and each located in discrete relation to the other to establish a distance (44) between the boundaries of the discrete elements (see for example the embodiment of FIGS. 2-4 and the embodiment FIGS. 5-7 which shows the chest plate (12) being discrete from the hip panel (19)). As to certain embodiments of the inventive chest physiotherapy device (1) (see for example FIGS. 2-4,) a hip panel support (46) to which the hip panel (19) couples can be entirely discrete from a chest plate support (47) to which the chest plate (12) couples. Providing discrete supports (46) (47) for the hip panel (19) and the chest plate (12) provides an embodiment of a vibration isolation means (45) which functions to eliminate or reduce the amount of vibration (13) generated in the chest plate (12) transmitted to the hip panel (19).

Again referring primarily to FIGS. 5-9, the hip panel support (46) and the chest plate support (47) can take the unitary constructional form of a support frame (24) which receives or couples to both the hip panel (19) and the chest plate (12). As shown in FIGS. 5-9, a particular embodiment of the support frame (24) can have configuration which receives the hip panel (19) and the chest plate (12) as discrete elements located a distance apart (44). The hip panel (19) and the chest plate (12) can be removably received by the support frame (24) or can be fixedly coupled to the support frame (24) by mechanical fasteners such as bolts or screws. The support frame (24) can provide a cross member (49) (see for example FIG. 9 or other type of support member) to further support the hip panel (19) or the chest plate (12) or both. As to certain embodiments of the chest physiotherapy device (1), the chest plate (12) can engage the support frame (24) at each of a pair of chest plate sides (50) (51) while the top of the chest plate (52) and the bottom of the chest plate (53) can remain uncoupled from the support frame (24) or the cross member (49). The affirmative step to establish the top of the chest plate (52) and the bottom of the chest plate (53) uncoupled or vibrationally uncoupled from the support frame (24) provides a non-limiting embodiment of the vibration isolation means (45) to eliminate or reduce transmission of the amount of vibration (13) in the chest plate (12) to the hip panel (19) or reduces vibration of the hip (20) (also referred to as hip vibration)(see for example FIG. 9 which shows a gap (48) between the cross member (49) and the bottom of the chest plate (53)).

As to particular embodiments of the invention, the chest plate (12) or the hip panel (19), or both can further provide a pad layer (54) and can further provide a cover layer (55) over the pad layer (54). The pad layer (54) and the cover layer (55) can engage the surface of the hip panel (19) and the chest plate (12) as a continuous unbroken pad layer (54) and a continuous unbroken cover layer (55) even though the hip panel (19) and the chest plate (12) are provided as discrete elements.

Figure 4:
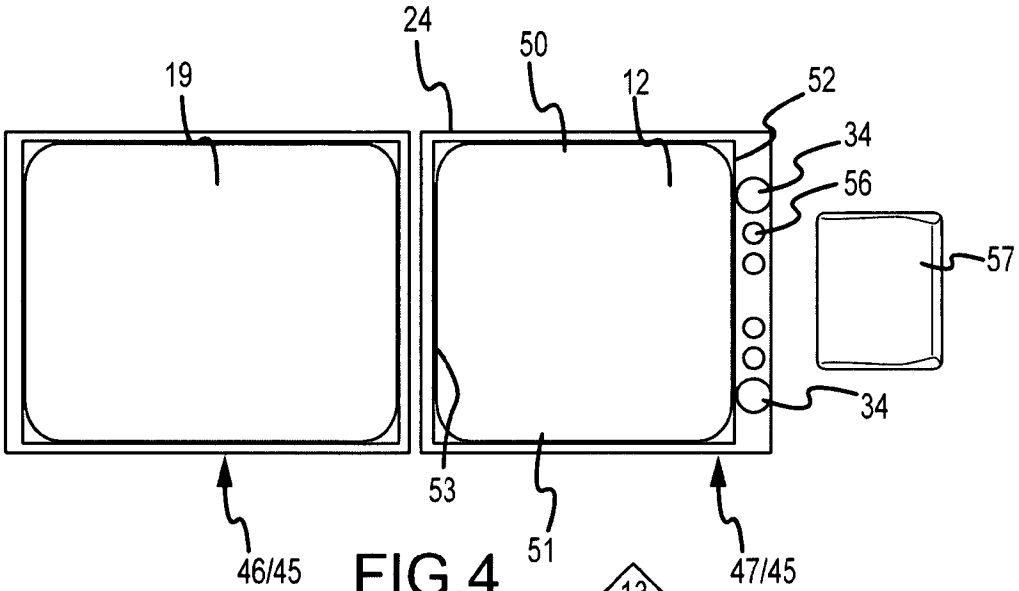
FIG. 4 is a top view of a particular embodiment of the inventive chest physiotherapy device.

Now referring primarily to FIGS. 2 and 4, the invention can further include a pair of shoulder engagement elements (34) which can be discrete from or coupled to the chest plate support (47) or at the end of the support frame (24) proximate to location of the chest plate (12). Each of the pair of shoulder engagement elements (34) has a location which upon engagement with the top of the shoulders (6) of a person (4) locates the chest (5) of the person (4) to engage the chest plate (12) at the desired location. To accommodate the various sizes of persons (4), the shoulder engagement elements (34) can each provide a variably adjustable shoulder engagement location element (56). The variable adjustable shoulder engagement location element (56) can as to a non-limiting embodiment of the invention a provide a plurality bore into which the shoulder engagement location element can slidly mate.

Again referring primarily to FIGS. 2-7, the invention can further provide a head support (57) which engages the head (58) of a person (4) when the chest (5) of the person (4) engages the chest plate (12). The head support (58) can be provided as a discrete element, coupled or variably adjustably coupled to the chest plate support (47).

Figure 5:
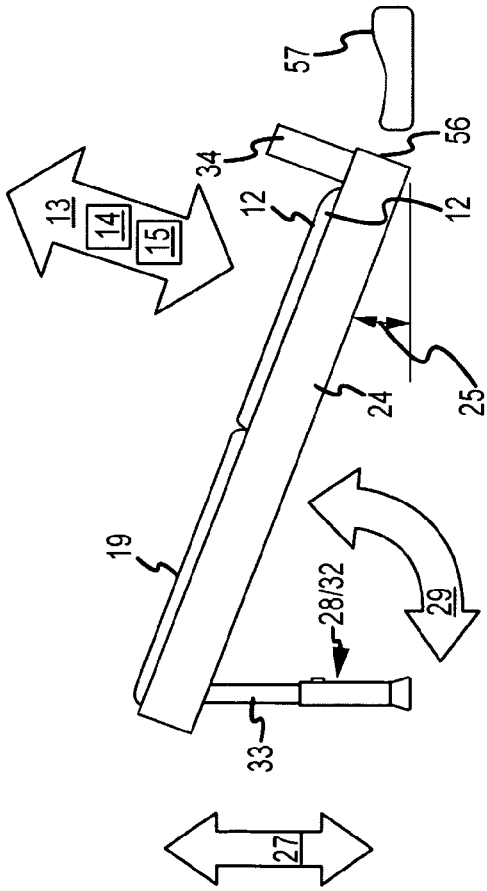
FIG. 5 is a side view of a particular embodiment of the inventive chest physiotherapy device in the inclined position.

Now referring primarily to FIGS. 1-9, the inventive chest physiotherapy device (1) can further provide a height elevation assembly (28) which operates to adjust the height (27) of the hip panel (19) in relation to the chest plate (12) to correspondingly elevate the hips (20) in relation to the chest (5). As a non-limiting example, the height elevation assembly (28) can comprise a pair of legs (33). The pair of legs (33) can extendably retract to generate an amount of incline (25) of greater or lesser amount in the hip panel (19) and the chest plate (12). As shown in FIGS. 1 and 5, as to embodiments of the inventive chest physiotherapy device (1) which provide a support frame (24), the pair of legs (33) can be coupled to the end of the support frame (24) proximate to the hip panel (19). The pair of legs (33) in the retracted condition (31) (see for example FIG. 5) can establish the hip panel (19) and the chest plate (12) at the same height (27) without any amount of incline (25). In the retracted condition (31) of the height elevation assembly (28), a person (4) having the chest (5) engaged to the chest plate (12) and the hip (20) engaged with the hip panel (19) would correspondingly not have an amount of incline (25). In the extended condition (32), a person (4) having the chest (5) engaged to the chest plate (12) and the hip (20) engaged with the hip panel (19) would correspondingly have an amount of incline (25).

Now referring primarily to FIG. 5, the pair of legs (33) can pivot about a pivot axis (30) between the retracted condition (31) and the extended condition (32) to establish the hip panel (19) and the chest plate (12) in substantially horizontal relation to the support surface (59) such as the surface of the floor or the surface of a table or having an amount of incline (25) in relation to the support surface (59).

As can be easily understood from the foregoing, the basic concepts of the present invention may be embodied in a variety of ways. The invention involves numerous and varied embodiments of a chest physiotherapy device and methods of using the chest physiotherapy device.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "vibrator" should be understood to encompass disclosure of the act of "vibrating"—whether explicitly discussed or not—and, conversely, were there effectively disclosure of the act of "vibrating", such a disclosure should be understood to encompass disclosure of a "vibrator" and even a "means for vibrating." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

Thus, the applicant(s) should be understood to claim at least: i) each of the chest physiotherapy devices herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth below are intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A method of physiotherapy comprising the steps of:

a) providing a chest plate and a hip panel each discretely coupled to a support frame;

b) engaging a chest plate to a chest of a person;

c) generating an amount of vibration substantially isolated to said chest plate engaged to said chest of said person; and d) adjustably controlling said amount of vibration in said chest plate engaged to said chest of said person to establish a level of said amount vibration over a period of time sufficient to induce an amount of chest vibration inside said chest of said person which assists in transfer of an amount of airway passage secretions.

2. A method of physiotherapy as described in claim 1, further comprising the step of engaging said hip panel to a part of a hip of said person.

3. A method of physiotherapy as described in claim 2, further comprising the step of establishing height of said part of said hip engaged to said hip panel at a height greater than said part of said chest engaged to said chest plate to establish said person on an incline as said amount vibration in said chest plate induces said amount of chest vibration in said chest of said person.

4. A method of physiotherapy as described in claim 3, further comprising establishing an amount of incline of said person having said part of said chest engaged to said chest plate sufficient to allow force of gravity to assist in removal of said lung secretion.

5. A method of physiotherapy as described in claim 1, further comprising the step of variably adjusting frequency of said amount of vibration in said chest plate.

6. A method of physiotherapy as described in claim 5, further comprising the step of variably adjusting amplitude of said amount of vibration in said chest plate.

7. A method of providing a chest physiotherapy device, comprising the steps of a) providing a chest plate configured to engage a chest of a person;

b) providing a hip plate configured to engage a hip of said person, said chest plate and said hip panel each discretely coupled to a support frame, wherein said chest plate includes a vibration isolation element;

c) coupling a vibration generator to said chest plate, wherein said vibration isolation element substantially isolates an amount of vibration to said chest plate; and d) coupling a vibration controller to said vibration generator which allows adjustable control of an amount of vibration established in said chest plate over a period of time sufficient to induce an amount of chest vibration in said chest of said person which assists in transfer of an amount of airway passage secretions.

8. A method of providing a chest physiotherapy device as described in claim 7, further comprising the step of coupling a height elevation assembly to said support frame at a location which allows said hip panel to be elevated at a greater height than said chest plate.

9. A method of providing a chest physiotherapy device as described in claim 8, further comprising the step of pivotally coupling said height elevation assembly to said support frame to allow rotation of said height adjustment assembly between a first position which establishes said hip panel and said chest plate at a substantially equal height and a second position which establishes an incline in said support frame to locate said hip panel at a vertical height greater than said chest plate.

10. A method of providing a chest physiotherapy device as described in claim 9, wherein said step of pivotally coupling said height elevation assembly to said support frame comprises the step of coupling a variably adjustable height elevation assembly to said support frame.

11. A method of providing a chest physiotherapy device as described in claim 7, further comprising the step of coupling a pair of shoulder engagement elements to said support frame each one of said pair of shoulder engagement elements located to engage a corresponding shoulder of a person which correspondingly locates said part of said chest to engage said chest plate.

12. A method of providing a chest physiotherapy device as described in claim 7, further comprising the step of including a frequency control element as part of said variable adjustable vibration controller which allows variably adjustable selection of a frequency of said amount of vibration in said chest plate.

13. A method of providing a chest physiotherapy device as described in claim 12, further comprising the step of including an amplitude control element as part of said variable adjustable vibration controller which allows variably adjustable selection of an amplitude of said amount of vibration in said chest plate.

14. A method of providing a chest physiotherapy device as described in claim 13, further comprising the step of including a timer as part of said variable adjustable vibration controller which allows timed duration of said amount of vibration in said chest plate.

* * * * *